United States Patent [19]

Deve

[11] 3,934,859

[45] Jan. 27, 1976

[54] MIXING APPARATUS

[75] Inventor: Vagn Deve, East Washington, Pa.

[73] Assignee: Combustion Engineering, Inc., Windsor, Conn.

[22] Filed: Apr. 25, 1974

[21] Appl. No.: 464,020

Related U.S. Application Data

[63] Continuation-in-part of Ser. No. 412,233, Nov. 2, 1973, abandoned.

[52] U.S. Cl. ..... 259/8; 259/14

[51] Int. Cl.[2] ..... B01F 7/10

[58] Field of Search ..... 259/3, 8, 14, 23, 24

[56] References Cited

UNITED STATES PATENTS

| | | | |
|---|---|---|---|
| 3,158,358 | 11/1964 | Fischer | 259/8 X |
| 3,256,573 | 6/1966 | Hunter | 259/178 A X |
| 3,288,052 | 11/1966 | Hough | 239/223 X |
| 3,400,915 | 9/1968 | Onishi | 259/8 |
| 3,457,047 | 7/1969 | Tokimatsu | 259/24 X |
| 3,741,223 | 6/1973 | Kavera | 259/8 X |

FOREIGN PATENTS OR APPLICATIONS

| | | | |
|---|---|---|---|
| 838,593 | 5/1952 | Germany | 259/24 |

*Primary Examiner*—Harvey C. Hornsby
*Assistant Examiner*—Alan Cantor
*Attorney, Agent, or Firm*—Robert L. Olson

[57] ABSTRACT

A mixing device for intimately mixing two or more different materials including a rotatable member of circular cross section, a shaft rotatable along with the rotatable member having two or more vertically spaced discs fastened thereto, and means for introducing one of the materials onto each disc, so that centrifugal force throws the materials onto the inner wall of the rotating member, thereby causing intimate blending or mixing.

6 Claims, 3 Drawing Figures

MIXING APPARATUS

CROSS REFERENCE TO RELATED APPLICATION

This application is a Continuation-in-Part of Applicant's copending application Ser. No. 412,233 filed Nov. 2, 1973 (abandoned) and assigned to the same assignee as the present invention.

BACKGROUND OF THE INVENTION

One method of producing foundry molds is to utilize a quick-setting sand, resin, catalyst mixture. These materials are kept separated until a mold is to be made, at which time the three materials must be mixed, with the mixture then being fed to a molding machine. In order to obtain molds of the desired strength, the sand, resin and catalyst must be rapidly and intimately or thoroughly mixed, due to the quick-setting nature of the mixture.

SUMMARY OF THE INVENTION

One form of mixing apparatus of the invention utilizes a rotating frustoconical housing, with the sand, resin and catalyst being centrifugally flung onto the inner surface thereof. The inner surface of the housing can be roughened by having a plurality of diamond-shaped protrusions thereon, to aid blending of the materials. Another embodiment utilizes an inverted frustoconical housing which rotates.

DESCRIPTION OF THE PREFERRED EMBODIMENT

Figure 1:
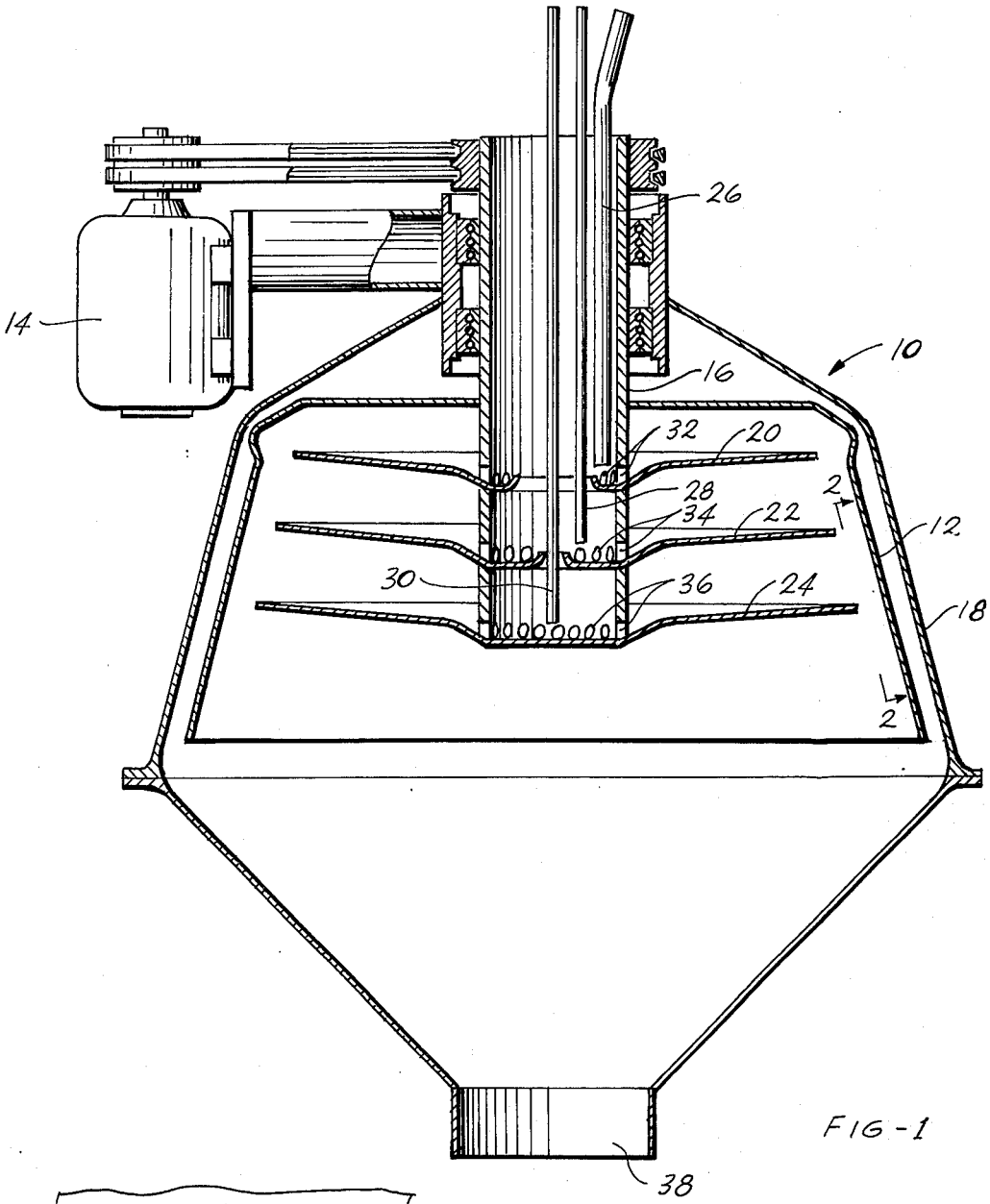
FIG. 1 is a cross section of the mixing device constructed in accordance with the invention.

Looking now to FIG. 1, numeral 10 designates a mixing device in its entirety. A frustoconical member 12 is rotatably driven by motor 14 by means of hollow shaft 16. The rotatable member is enclosed by a stationary housing 18. Secured to the shaft 16, and rotatable therewith, are three vertically spaced discs 20, 22 and 24. Pipes 26, 28 and 30 extend downwardly through shaft 16, each one terminating at a point slightly above one of the discs 20, 22 and 24.

Pipe 26 supplies disc 20 with a metered amount of sand through restricted openings 32, which ensures the even distribution of sand throughout a 360° arc onto the disc. Pipe 28 supplies a metered amount of resin to disc 22 through restricted openings 34, and pipe 30 supplies a metered amount of catalyst to disc 24 through restricted openings 36. Stationary housing 18 has a bottom discharge opening 38, through which the mixed materials are gravity discharged.

The operation of the mixing device of FIG. 1 will now be described. A metered amount of sand is introduced to disc 20 through pipe 16. Centrifugal force causes the sand to be thrown outwardly into contact with the inner surface of rotating member 12. The sand moves downwardly along the inner wall of member 12 in a thin layer, past disc 22, where it is subjected to a fine spray of resin fed in a metered amount through pipe 28 onto disc 22. The now resinous sand slides further downwardly along the inner wall of member 12 past disc 24, where it is subjected to a fine even spray of catalyst which is fed in a metered amount through pipe 30 onto disc 24.

Figure 2:
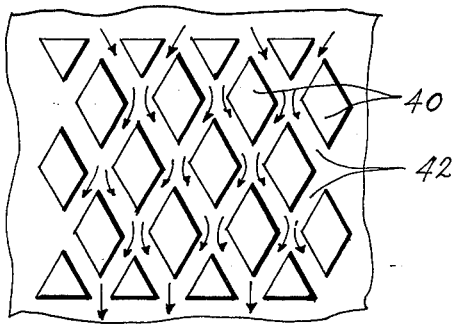
FIG. 2 is a view looking along lines 2—2 of FIG. 1.

Depending on the wall angle and speed of rotation of member 12, the materials move toward the lower edge of the member 18 at a given speed, and due to the friction on the inner surface, the materials will mix and intermingle. Various dams or surface roughenings can be used on the inner surface of member 18, to increase the frictional contact between the materials and the rotating member 18. A preferable surface is shown in FIG. 2, and consists of a plurality of diamond-shaped protrusions 40. This configuration not only increases the centrifugal force, but also causes the material to keep dividing and re-blending in the channel 42 between the upraised diamonds 40. The intimately mixed materials are flung off the bottom edge of member 18, resulting in a final shear-action mixing as the mixture hits the stationary housing, and then gravitates along the inclined wall of stationary housing 18 to the opening 38.

Figure 3:
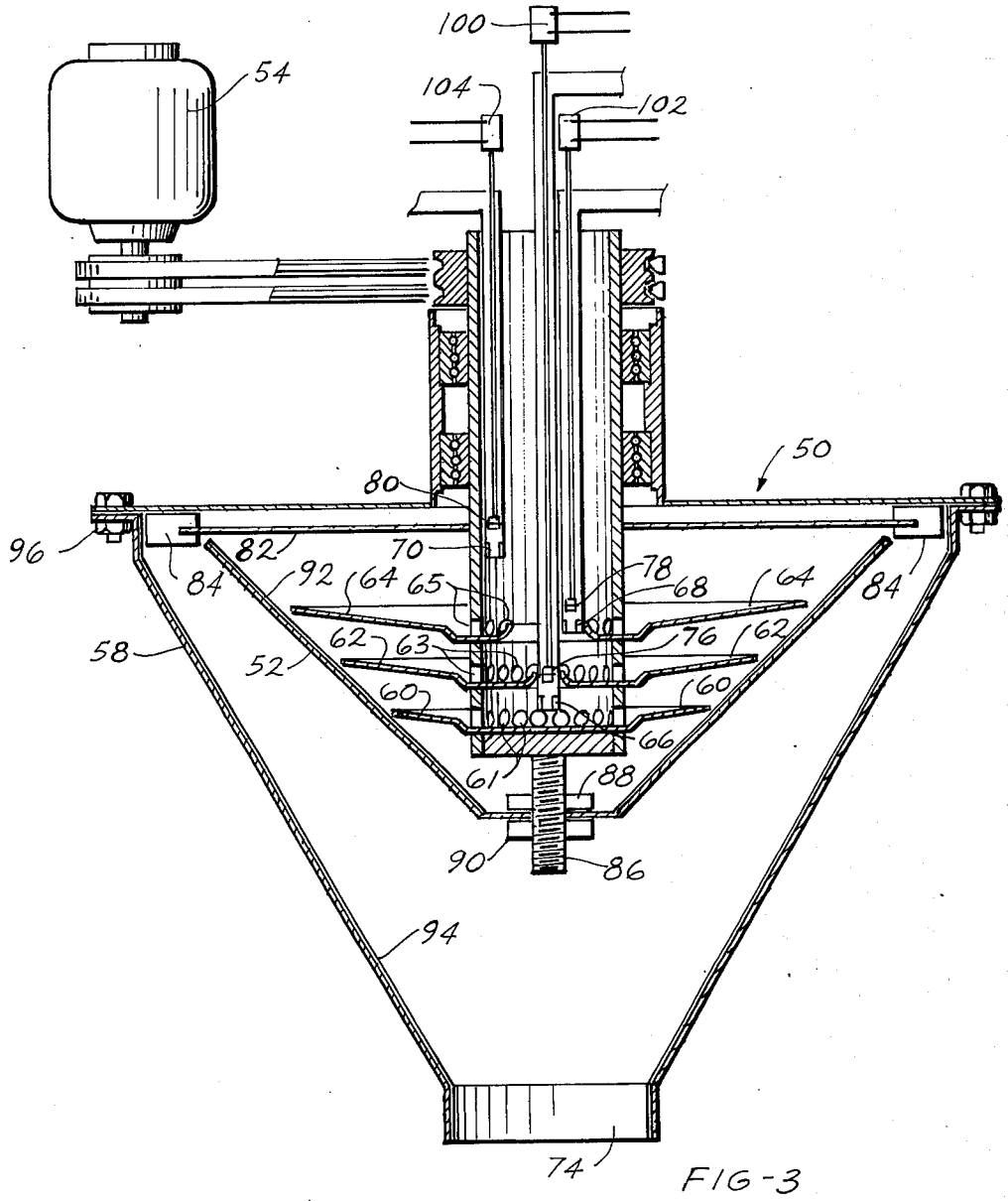
FIG. 3 is a cross section of a second embodiment of a mixing device constructed in accordance with the invention.

Looking now to FIG. 3, an alternative mixing arrangement 50 is shown. A frustoconical member 52 is rotatably driven by motor 54 by means of a hollow shaft 56. The rotatable member 52 is enclosed by a stationary housing 58. Secured to the shaft 56, and rotatable therewith, are three vertically spaced discs 60, 62 and 64. Pipes 66, 68 and 70 extend downwardly through the shaft 56, each one terminating at a point slightly above one of the three discs 60, 62 and 64.

Pipe 66 supplies disc 60 with a metered amount of sand. The sand passes through restricted openings 61 and is thrown outwardly by centrigual force, with the restricted openings 61 ensuring the even distribution of sand throughout a 360° arc. Pipe 68 supplies a metered amount of resin to disc 62 through restricted openings 63, and pipe 70 supplies a metered amount of catalyst to disc 64 through restricted openings 65. The sand, resin and catalyst are flung outwardly onto the inner wall of rotating member 52. The speed of rotation of member 52 is such, for example 1500 rpm, that centrifugal force causes the materials to move outwardly and upwardly, and exits through the upper open end 72 of the inverted frustoconical member 52. An upper plate 82 is secured to the shaft 56, so as to be rotatable therewith. Attached to plate 82 is a plurality (for example four) of blades 84, which are positioned closely adjacent to the top and sidewalls of stationary housing 58, said blades having such an angle that they propel the sand mixture downward toward the outlet 74. Since plate 82 rotates, centrifugal force prevents any buildup of the sticky, viscous mixture of sand, resin and catalyst which comes into contact with plate 82. Also, the blades 84 continuously clean the outer upper portion and upper sidewall of the stationary housing 58.

The size of the upper annular opening 72 between member 52 and cover plate 82 can be adjusted by means of the nuts 88 and 90, which secure member 52 to the shaft 56. By threading nut 88 upwardly or downwardly on bolt 86, prior to tightening nut 90, the member 52 can be moved toward or away from the cover plate 82. The opening 72 should be adjusted such that the amount of mixed materials leaving member 52 is just slightly less than the amount of material being introduced to it. Thus there will be a small buildup of material sealing the opening 72 during the mixing operation. This has two advantages. First, it keeps sand, dust and liquid mist around the mixer to a minimum; and secondly, it results in some shear, intimate mixing action of the sand, resin and catalyst material just prior to its leaving rotating member 52 through annular opening 72. The mixed material passing through opening 72 is gravity discharged from the stationary housing 58 through bottom opening 74.

After a batch of materials has been mixed in the mixer 50, the valves 76, 78 and 80 in pipes 66, 68 and 70 are closed by solenoids 100, 102 and 104, respectively. The valves are located at the very bottom of the pipe outlet in order to prevent materials from dripping out after a batch of materials has been mixed. The catalyst and resin become sticky when exposed to the atmosphere, and would build up deposits on the discs if droplets fell out onto the discs after each mixing operation.

Because the most wear on the mixer will occur on the inner wall of frustoconical member 52, where the sand is thrown and travels upwardly and outwardly thereacross, a replaceable plastic insert liner 92 is used, which snaps into place by snugly fitting over the upper edge of member 52. The stationary housing 58 also contains a removable liner 94 made of a flexible material, such as rubber. As mentioned earlier, the mixture is sticky, and an operator can occassionally shake out the liner 94 to remove any deposits building up on the wall. Access to the inside of stationary housing 58 is provided by removal of nuts and bolts 96, so that the lower portion of housing 58 can be removed. The plastic liner 92 can then be replaced by loosening nut 90 and removing member 52. It should be obvious that some of the features shown and described in the FIG. 3 embodiment could also be used with advantage in the embodiment of FIG. 1, such as for example the rubber liner 94, and the valves in the feed pipes.

What is claimed is:

1. Apparatus for mixing two materials, including an upright vertical housing having a circular cross section, a central shaft positioned within the housing, a first disc secured to the shaft, a second disc secured to the shaft below the first disc, means for rotating the housing and shaft, a first pipe located within the shaft for introducing a first material onto the upper surface of the first disc, a second pipe located within the shaft for introducing a second material onto the upper surface of the second disc, both the first and second pipes containing valve means at their outlet ends, and one end of the housing being open, through which the mixed material can be discharged.

2. Apparatus for mixing two materials, including an upright vertical housing having a circular cross section, a central shaft positioned within the housing, a first disc secured to the shaft, a second disc secured to the shaft below the first disc, means for rotating the housing and shaft, means for introducing a first material onto the upper surface of the first disc, means for introducing a second material onto the upper surface of the second disc, the inner surface of the housing having a plurality of diamond-shaped protrusions thereon, and outlet means in the lower portion of the housing through which the mixed material can be discharged.

3. Apparatus according to claim 2, including a second, stationary housing, the major portion of which is positioned below the first housing, the lower portion of said second housing being in the shape of an inverted cone, and the second housing having an outlet located at the apex of said cone.

4. Apparatus for mixing three materials, including an upright vertical housing having a circular cross section, a central shaft positioned within the housing, a first disc secured to the shaft, a second disc secured to the shaft below the first disc, a third disc secured to the shaft below the second disc, means for rotating the housing and shaft, means for introducing a first material onto the upper surface of the first disc, means for introducing a second material onto the upper surface of the second disc, means for introducing a third material onto the upper surface of the third disc, the means for introducing the first, second and third materials onto the discs being three pipes located within the shaft, the inner surface of the housing having a plurality of diamond-shaped protrusions thereon, and outlet means in the lower portion of the housing through which the mixed material can be discharged.

5. Apparatus according to claim 4 including a second stationary housing, the major portion of which is positioned below the first housing, the lower portion of said second housing being in the shape of an inverted cone, and the second housing having an outlet located at the apex of said cone.

6. Apparatus according to claim 4 wherein the three pipes terminate at points slightly above their respective discs.

* * * * *